United States Patent [19]

Carson

[11] 4,022,139

[45] May 10, 1977

[54] TACKER GUIDE AND METHOD

[75] Inventor: Charles F. Carson, Greensboro, N.C.

[73] Assignee: Blue Bell, Inc., Greensboro, N.C.

[22] Filed: Oct. 28, 1975

[21] Appl. No.: 626,022

[52] U.S. Cl. ..... 112/150; 112/104; 112/153; 112/265

[51] Int. Cl.[2] ..... D05B 35/00; D05B 3/12

[58] Field of Search ..... 112/153, 151, 150, 136, 112/140, 18, 20, 51, 104, 262, 265, 235; 33/42, 174 B, 174 G

[56] References Cited

UNITED STATES PATENTS

| | | | |
|---|---|---|---|
| 380,683 | 4/1888 | James | 112/153 |
| 1,117,564 | 11/1914 | Halliday | 112/153 |
| 2,573,170 | 10/1951 | Wiegandt | 112/153 X |
| 2,757,625 | 8/1956 | Cerillo | 112/104 |
| 3,146,743 | 9/1964 | Minehan | 112/151 |
| 3,509,633 | 5/1970 | Fernandes | 33/174 G |
| 3,548,505 | 12/1970 | DiCandilo | 33/174 G |
| 3,797,422 | 3/1974 | Sakawa | 112/104 |

*Primary Examiner*—H. Hampton Hunter

[57] ABSTRACT

A tacking sewing machine having a presser foot and needle for tacking multiple fabric plies in which a fabric limiting or stop means positions the fabric plies to be tacked and fabric guide means cooperatively associated therewith guides fabric plies to the limiting means in juxtaposition to a presser foot.

4 Claims, 7 Drawing Figures

TACKER GUIDE AND METHOD

BACKGROUND, OBJECTIVES AND ADVANTAGES OF THE INVENTION

Single-needle, lockstitch sewing machines designed for barring and tacking operations are widely used in the apparel industry for stitching flat buttons, bar-tacking selected fabric plies together in predetermined sections, and bar-tacking pocket corners for added reinforcement, among other applications. In conventional tacking, the machine operator is required visually to position the fabric to be tacked in a specific location before the tacking operation may proceed. Aligning and positioning the fabric plies to be tacked are time consuming, fatiguing on the operator and costly operations. Furthermore, a high incidence of imperfect tacking alignment may occur which will result in inferior quality garments.

Although many different edge guides have been employed in conjunction with various types of sewing machines, none has been found suitable for barring and tacking operations which will eliminate the aforementioned problems. Furthermore, many different stop means have been employed in conjunction with certain types of sewing machines, and various templates are employed in the garment industry, but none has been found suitable for positioning multiple fabric plies with any degree of precision for barring and tacking operations which will facilitate ease of operation and positioning by the operator with consistent uniformity.

Therefore, it is an objective of this invention to provide a device for a tacking sewing machine for positioning multiple fabric plies to be tacked at a predetermined location.

Another objective of this invention is to provide a tacking sewing machine having a presser foot and needle for tacking multiple fabric plies with a multiple fabric ply limiting means and a fabric guide means cooperatively associated therewith to guide multiple plies fabric to the stop means in juxtaposition with a presser foot.

Still another objective of this invention is to provide means which will enable a machine operator on a tacking sewing machine to align and position multiple fabric plies at a predetermined location accurately with minimum visual alignment to achieve maximum uniformity in tacking operations.

A further objective of this invention is to incorporate a combination stop means and fabric guide means on a presser foot to accommodate the positioning of multiple fabric plies for tacking thereby increasing production, improving quality and uniformity.

Yet another objective of this invention is to provide a method of tacking multiple fabric plies by guiding and positioning them at a predetermined location uniformly under a pressure foot.

Other objectives and many of the attendant advantages of this invention will become more readily apparent to those skilled in the sewing machine art from the following detailed descriptions of the drawing, a preferred embodiment and method of this invention. Although the invention is described specifically in conjunction with a bar-tacking operation it is applicable to tacking in general which is an arrangement of stitches made by a cam-controlled sewing machine for producing a predetermined pattern or design.

DESCRIPTION OF DRAWING OF PREFERRED EMBODIMENT

DETAILED DESCRIPTION OF PREFERRED EMBODIMENT AND METHOD OF THE INVENTION

Figure 1:
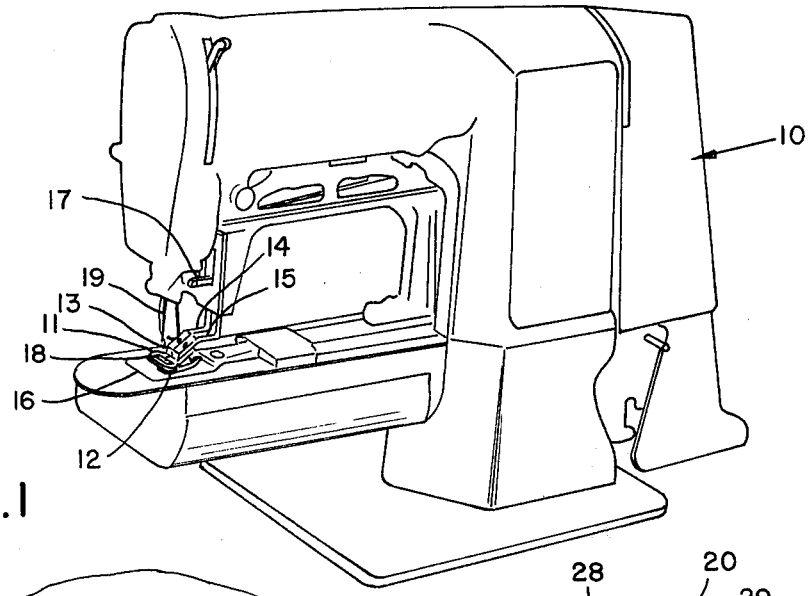
FIG. 1 is a front perspective view of a single-needle, lockstitch sewing machine for barring and tacking operations in which the tacker guide and stop are mounted on the bottom side of one portion of a presser foot.
Figure 2:
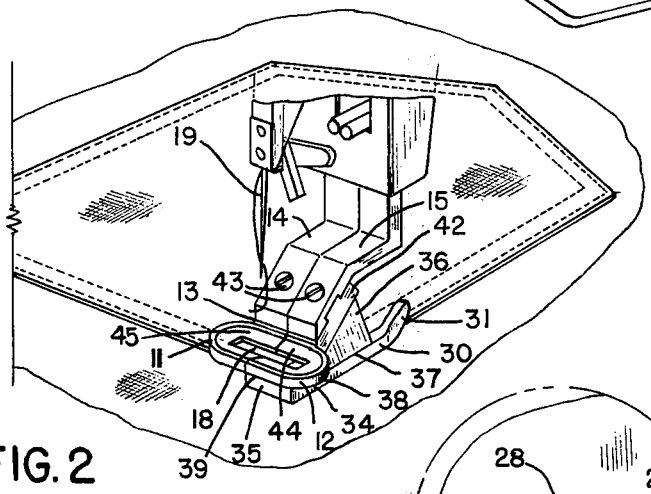
FIG. 2 is an enlarged perspective view of the presser foot carrier in which an articulated presser foot is supported, and a needle positioned thereabove with a pocket having rearwardly folded edges on a garment positioned to be tacked against the tacker guide and stop device.
Figure 6:
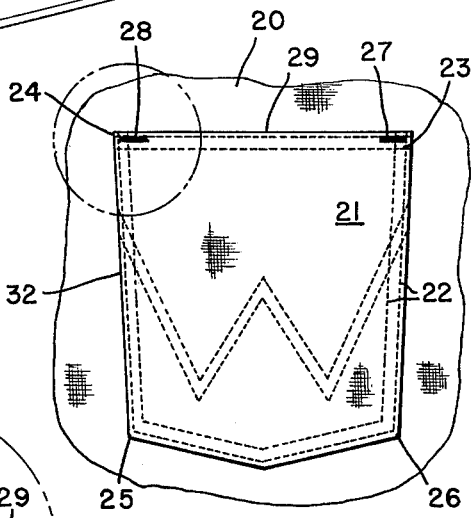
FIG. 6 is a plan view of a pocket bar-tacked at each of the upper corners thereof.
Figure 7:
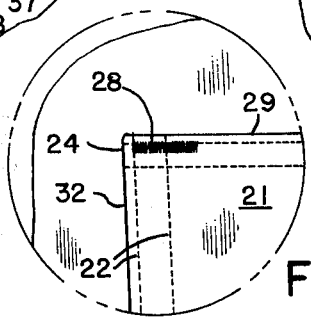
FIG. 7 is an enlarged plan view from within the circle of FIG. 6 illustrating a bar-tacked pocket corner.
Figure 3:
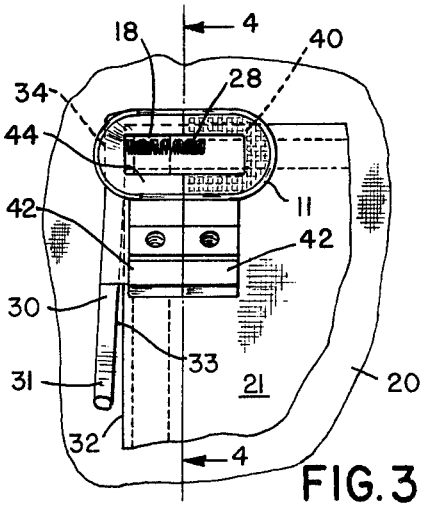
FIG. 3 is an enlarged top plan view of the tacker guide and stop device with a pocket corner having multiple fabric plies in position as shown in FIG. 2.

Referring to the drawing and particularly to FIG. 1, there is illustrated a conventional single-needle, lockstitch sewing machine designed for barring and tacking operations in Class 269W manufactured by The Singer Company in which the conventional drive mechanism and feeding mechanism are employed in conjunction with a feed plate. A pair of articulated members 11 and 12 from the presser foot 13 which members 11 and 12 are secured to the projecting presser foot carriers 14 and 15 that extend horizontally, at one portion, and vertically in the other portion to be retained for vertical displacement into and out of engagement with the feed plate 16 or fabric to be bar-tacked. A conventional presser foot lifter 17 is positioned to raise and lower the presser foot 13. The members 11 and 12 of the presser foot 13 illustrated in FIGS. 1-3 are provided with laterally extending slots to form a needle traverse opening 18 in the assembled presser foot 13 for the needle 19. The extent and travel of the needle 19 within the opening 18 may be appropriately controlled through conventional means for the extent of the tack desired for a specific tack application.

The specific application of the present invention will be described in conjunction with bar-tacking the upper edges of a pocket at the open portion 29 as shown in FIGS. 2, 3, 6, and 7. The base or main fabric ply 20 which may be of denim or other suitable fabric may have a single ply of a definite thickness. The pocket 21 is sewn to the base fabric 20 by suitable stitching 22 after the pocket edges have been turned inwardly to form a double ply of fabric about the perimeter of the pocket. The upper edge 29 of the pocket may have a double-fold before stitching resulting in three fabric plies. Six plies of fabric are formed by folding at the corners 23 and 24. The bar-tackig required for completing the operation on the pocket securement to the base fabric or garment 20 necessitates positioning two bar-tacks 27 and 28 at the upper extremities adjacent to the upper edge 29 of the pocket for additional reinforcement.

Presently some machine operators must gauge, by visual alignment, the location of the bar-tacks 27 and 28 generally with some shifting and turning of the garment a number of times to position the pocket precisely for the bar-tack. The pocket must be accurately placed under the opening 18 in the presser foot 13 enabling the needle 19 to make the desired placement of the tack. The present invention eliminates the normal visual alignment and repositioning with the provision of a vertical fabric guide member 30 which has an upwardly extending toe 31 that may be positioned at a slight angle from linear alignment with a pocket edge 32 as shown in FIG. 3. This slight divergence may be provided for the purpose of facilitating positioning a pocket by sliding the pocket corner 24 and the adjacent edge 32 initially against the inner wall 33 of the guide 30. The heel 34 of the guide 30 may be straight and may serve as one portion of a limiting stop which projects vertically and may have a height equivalent to approximately the six fabric plies at the pocket corner 24. A forward limit or stop member 35 which also has a height substantially the thickness of the six plies of fabric at the pocket corner 24 limits the forward movement of the pocket by engaging pocket edge 29 adjacent to the corner 24 thereby forming a corner-receiving template and stop for positioning the pocket corner 24 under the presser foot 13 as shown in FIGS. 2 and 3. The extent of the bar-tack 28 may vary depending upon the type of fabrics being sewn, among other factors. Conventionally, the bottom of the presser foot will be spaced slightly above the top of the feed plate 16 to receive at least one fabric ply therebetween.

In the preferred embodiment of this invention, a conventional pair of presser foot members 11 and 12 have been employed. The one presser foot member 12 has been modified by welding, or otherwise securing, the angle web 36 to the underside of the presser foot member 12. The guide member 30 is secured by welding to the lower edge 37 of the web 36 and to the lower surface 38 of the presser foot member 12. Similarly, the front stop or limit member 35 is securely fastened to the underside of the front portion 39 of the presser foot member 12.

Figure 4:
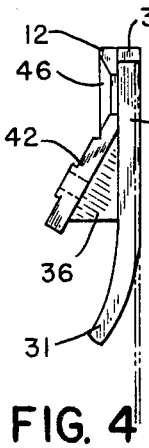
FIG. 4 is a sectional view taken substantially along line 4—4 of FIG. 3 illustrating the fabric guide and a portion of the fabric stop member.
Figure 5:
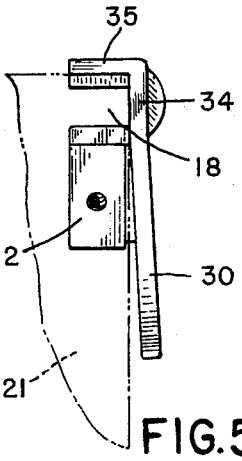
FIG. 5 is a right side elevational view of FIG. 4.

In the specific application for bar-tacking corners of pockets, the presser foot member 11 need not be modified unless a longer stop member than the stop member 35 is required. As shown in FIG. 4, the presser foot member 12 may be ground, if necessary, to remove serrated teeth 40 of the type illustrated on the undersurface of the presser foot member 11 in FIG. 3 in order to accommodate the limit or stop member 35 and the guide member 30. The upwardly extending fastening lug 42 for each of the presser foot members 11 and 12 need not be modified, and the securing screws 43 will retain each member in position on the forwardly projecting presser foot carriers 14 and 15. In the embodiment shown the transverse portion 44 of the presser foot member 12 is elevated to receive the six fabric plies thereunder without interference at the same elevation as the adjacent portion 45 of presser foot member 11. As illustrated in FIG. 3, the stop member 35 and the heel portion 34 may form a right angle against which sides the pocket corner 24 may be seated before tacking.

Each of the preser foot members 11 and 12 is provided with a chamfered upper surface 46 which is inclined downwardly toward the elongated rectangular opening 18 for the needle 19 to penetrate into the fabric plies. With the guide member 30 and stop member 35 fastened directly to the undersurface of the presser foot member 12, these members will be raised each time the presser foot is elevated. With the presser foot in slightly raised position, as shown in FIGS. 1 and 2, the operator may readily slide the fabric 20 under the presser foot while guiding the pocket edge 32 and pocket corner 24 against the guide member 30 until it reaches the seated or limit position against the limit or stop member 35, at which time the foot can be lowered and the tacking operation may commence without further alignment or realignment.

It is contemplated that the guide member 30 may be secured to the upper surface of the feed plate 16 and the limit or stop member 35 may be secured to the feed plate, if desired. It will also be readily apparent that the guide member and stop member may be made integral with the overall height depending upon the total thickness of the fabric plies to be tacked. Such modifications are within the scope of the appended claims and such mofifications are contemplated.

In practicing the method of this invention the pocket corner to be tacked may be moved in a directed path of travel, preferably against the guide member 30 to the limiting stop 35 in the seated position as shown in FIGS. 2 and 3 before tacking after which the tacked pocket corner may be removed for positioning and tacking another pocket corner. It will also be readily apparent that the limit stop 35 may serve as a guide member interchangeably with the guide member 30 which may serve as a stop or limit member depending upon ease of access and the contour of the garment portion to be tacked.

I claim:

1. A positioning guide for tacking in combination with a tacking sewing machine having a needle and a presser foot, said presser foot having a fabric-engaging bottom surface for tacking multiple fabric plies at a specific location comprising; a fabric stop means on said presser foot fabric-engaging bottom surface for limiting the movement of multiple fabric plies in one direction at a predetermined location beneath the presser foot in juxtaposition to said needle, and a means coacting with said fabric stop means and at an angle thereto on said presser foot fabric-engaging bottom surface for guiding said fabric plies to said fabric stop means.

2. A positioning guide for tacking in combination with a tacking sewing machine as claimed in claim 1, said stop means having a height substantially equivalent to the thickness of the fabric plies to be retained against said stop means.

3. A positioning guide for tacking in combination with a tacking sewing machine as claimed in claim 1, said stop means being secured to said presser foot, a fabric guide means substantially at a right angle to said stop means secured to said presser foot, said guide means extending beyond said presser foot to guide fabric plies cooperatively to said stop means, said stop means and said fabric guide means each having a vertical height substantially the total thickness of the fabric plies to be guided and stopped.

4. The method of tacking fabric plies on a tacking sewing machine having a needle and a presser foot, said presser foot having a fabric engaging bottom surface with a fabric stop means and a fabric guiding means at an angle thereto and cooperating therewith comprising the steps of guiding a plurality of fabric plies to be tacked along a first path of travel against said fabric guiding means, terminating the displacement of the plurality of fabric plies in the first path of travel upon engaging said fabric stop means thereby positioning the fabric plies in a predetermined tacking location, and tacking the fabric plies in said predetermined location.

* * * * *